US007889979B2

(12) United States Patent
Trevisan et al.

(10) Patent No.: US 7,889,979 B2
(45) Date of Patent: Feb. 15, 2011

(54) RADIANT DEVICE

(75) Inventors: Andrea Trevisan, Parma (IT); Stefano Nasi, Montechiarugolo (IT)

(73) Assignee: Mo-El S.r.L, Montecchio Emilia (IT)

( * ) Notice: Subject to any disclaimer, the term of this patent is extended or adjusted under 35 U.S.C. 154(b) by 676 days.

(21) Appl. No.: 10/573,956

(22) PCT Filed: Oct. 6, 2004

(86) PCT No.: PCT/IB2004/003259

§ 371 (c)(1),
(2), (4) Date: Mar. 1, 2008

(87) PCT Pub. No.: WO2005/036928

PCT Pub. Date: Apr. 21, 2005

(65) Prior Publication Data

US 2008/0240691 A1 Oct. 2, 2008

(30) Foreign Application Priority Data

Oct. 10, 2003 (IT) ..... MI2003A1960

(51) Int. Cl.
*A45D 20/40* (2006.01)

(52) U.S. Cl. ..... 392/407

(58) Field of Classification Search ..... 392/407, 392/408–440

See application file for complete search history.

(56) References Cited

U.S. PATENT DOCUMENTS 3,774,001 A 11/1973 Consoli et al.
3,915,180 A * 10/1975 Jacobs ..... 134/58 D
5,628,073 A * 5/1997 Popovich ..... 4/524
6,393,209 B2 * 5/2002 Kimura ..... 392/407
6,646,233 B2 * 11/2003 Kanno et al. ..... 219/390
6,654,549 B1 11/2003 Konishi
6,895,179 B2 * 5/2005 Kanno et al. ..... 392/416
7,138,606 B2 * 11/2006 Kanno et al. ..... 219/390
2002/0096984 A1 7/2002 Konishi et al.
2004/0037542 A1 2/2004 Konishi
2004/0096202 A1 5/2004 Konishi

FOREIGN PATENT DOCUMENTS

| | | | |
|---|---|---|---|
| DE | 1 835 907 | U | 8/1961 |
| DE | 1 835 908 | U | 8/1961 |
| DE | 1 186 156 | B | 1/1965 |
| DE | 54 092 | A1 | 2/1967 |
| FR | 1 381 506 | A | 12/1964 |
| GB | 1005559 | A | 9/1965 |
| JP | S41-9803 | | 5/1966 |
| JP | S48-63339 | | 9/1973 |
| JP | S61-205306 | | 9/1986 |
| JP | H3-199824 | | 8/1991 |
| JP | 2003-90672 | | 3/2003 |
| WO | WO 01/41507 | A1 | 6/2001 |

* cited by examiner

*Primary Examiner*—Daniel Robinson
(74) *Attorney, Agent, or Firm*—Pearne & Gordon LLP

(57) ABSTRACT

A radiant device (1) comprises a supporting frame (2) and at least a radiant element (4) having two mutually opposed ends (4*a*), each being provided with electrical connection terminals (7). The radiant element (4) engages hooking groups (3) of the supporting frame (2) by means of suitable electrical connection elements (9) placed between the ends (4*a*) and the hooking assemblies (3). The elastic connection elements (9) dampen collisions and/or vibrations, if present, and insulate at the same time the electrical parts of the device (1) both from fluid seepages and from overheating.

19 Claims, 5 Drawing Sheets

RADIANT DEVICE

The present invention relates to a radiant device comprising the features listed in the preamble of claim 1.

Namely, the present description will refer in particular to radiant devices used for heating surfaces and/or rooms, without limiting in any way the application of the present invention to lighting devices or radiant devices of other type, which are designed to emit energy on wavelengths that can be in the visible field, for instance through halogen-lamps, in the infrared field or in the ultraviolet field.

It is known about heating devices operating by radiation, which use as hot source a lamp supplied with electric current.

One of this devices is known from documents U.S. Pat. No. 6,654,549 and WO01/41507 disclosing an heating apparatus using an infrared ray lamp. The lamp has a structure wherein a groove is formed in the vicinity of each of both end portions of a substantially plate heating element and the end portion of the heating element is inserted into a slit formed at the end portion of a heat-emitting block, so as to be sandwiched.

It is also known from document FR1381506 an infrared heater which comprises an helical element in a quartz tube. The tube is cushioned by three layers of glass wool interposed between the tube and brass end ferrules by which it is supported, and to which connections are made.

Whatever the type of lamp used, in the devices according to the prior art the lamp is fitted into a housing frame comprising electrical connections that supply the lamp and connect it to the frame.

Due to the high operating temperature of such lamps, in order to prevent electrical connections from getting damaged or anyhow not to endanger their yield, the latter are made of materials with a good resistance to high temperatures and a low coefficient of heat transmission.

In the devices according to the prior art, in order to prevent powder or water in external applications from getting where electrical contacts are present (thus causing possible short-circuits), a screen made of glass or anyhow of a material as transparent as possible to operating wavelengths, seals hermetically the frame housing the lamp.

The Applicant has found that the heating devices operating by radiation according to the prior art can be improved under several aspects.

As a matter of fact, the radiation emitted by the lamp should necessarily get through the glass sealing hermetically the frame, and is partly reflected and partly absorbed and therefore only partly transmitted. This necessarily lowers the transmission yield of the radiation of the heating device.

Moreover, the materials which the electrical connections of the lamp are necessarily made of (ceramics, mica, alumina) are brittle or anyhow extremely stiff. Considering that the electrical connections act also as support for the lamp, its integrity can be seriously endangered even by small collisions or vibrations transmitted to the housing frame.

Moreover, the radiation reflected by the glass towards the inside of the frame increases temperature inside the frame, and therefore the various coefficients of thermal expansion between lamp and electrical connections lead to mechanical stresses in the lamp, which can cause its breaking.

The technical task underlying the present invention is to conceive a heating device operating by radiation that can obviate the above drawbacks.

In the framework of this technical task, an important aim of the invention is to propose a heating device operating by radiation that enables to achieve a higher transmission yield of the radiation than devices according to the prior art.

A further aim of the present invention is to propose a heating device operating by radiation in which the lamp is suitably protected from collisions or vibrations.

A still further aim of the present invention is to propose a heating device operating by radiation without mechanical stresses due to thermal expansions.

The technical task and the aims referred to are basically achieved by means of a heating device operating by radiation comprising the features listed in claim 1.

Here follows the description of a preferred but not exclusive embodiment of a heating device operating by radiation, given as a mere illustrative and non-limiting example, in the accompanying drawings, in which.

Figure 1:
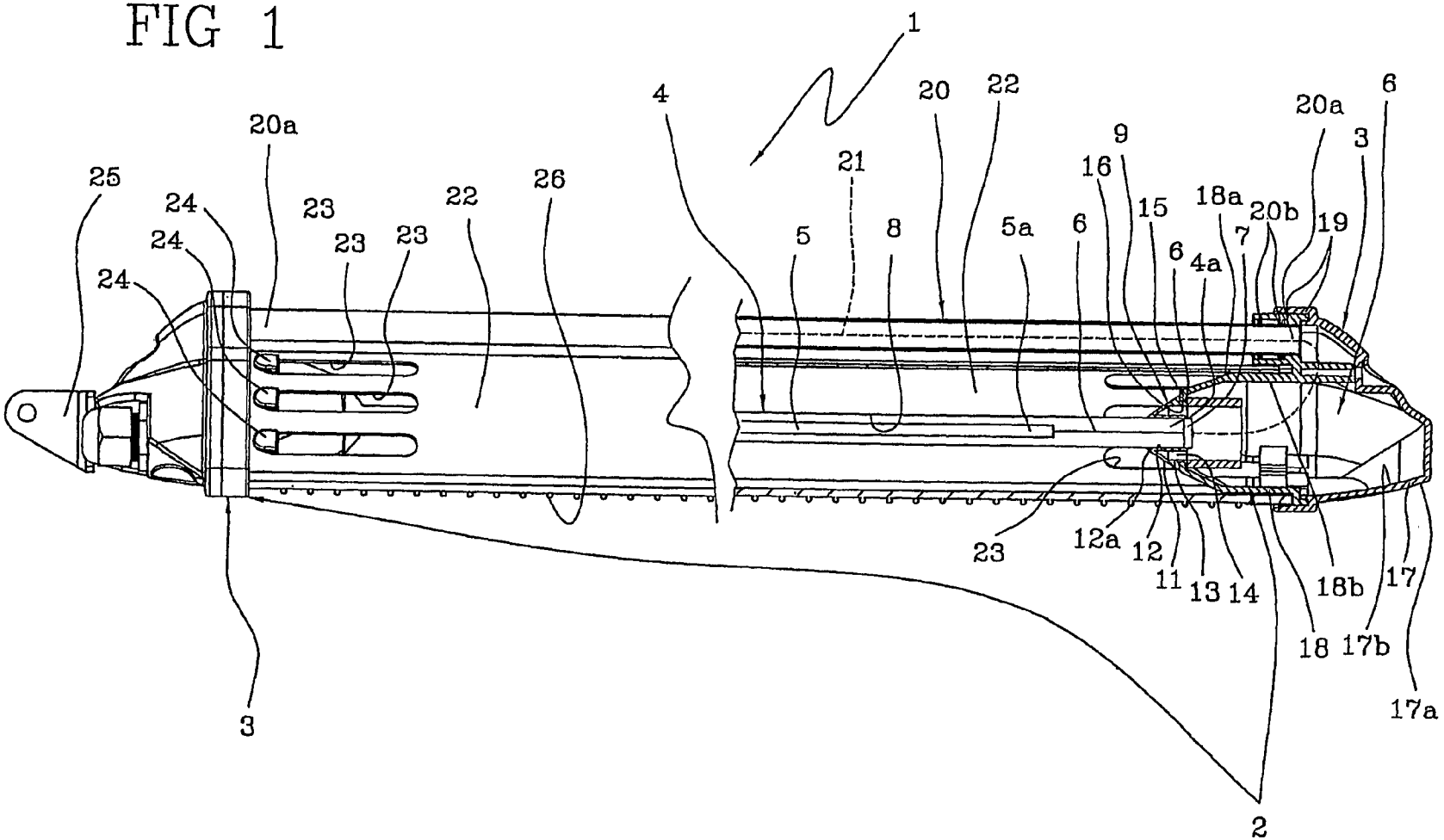
FIG. 1 is a longitudinal half-section of a radiant device according to the present invention.

With reference to the accompanying figures, number 1 refers globally to a radiant device according to the present invention.

The radiant device 1 comprises a supporting frame 2 provided with at least two hooking assemblies 3 designed for a temporary and/or final arrangement of said device in a given place. The hooking assemblies 3 are further arranged so as to carry at least a radiant element 4 designed for lighting, such as for instance incandescent lamps, fluorescent lamps, neon lamps and the like, or for heating by radiation, such as for instance infrared ray lamps and/or the like.

Preferably, the radiant device 1 is designed for heating private and or public rooms, closed rooms or open spaces, also subject to water spraying, high moisture with condensate formation and/or to contingent atmospheric agents.

Figure 2:
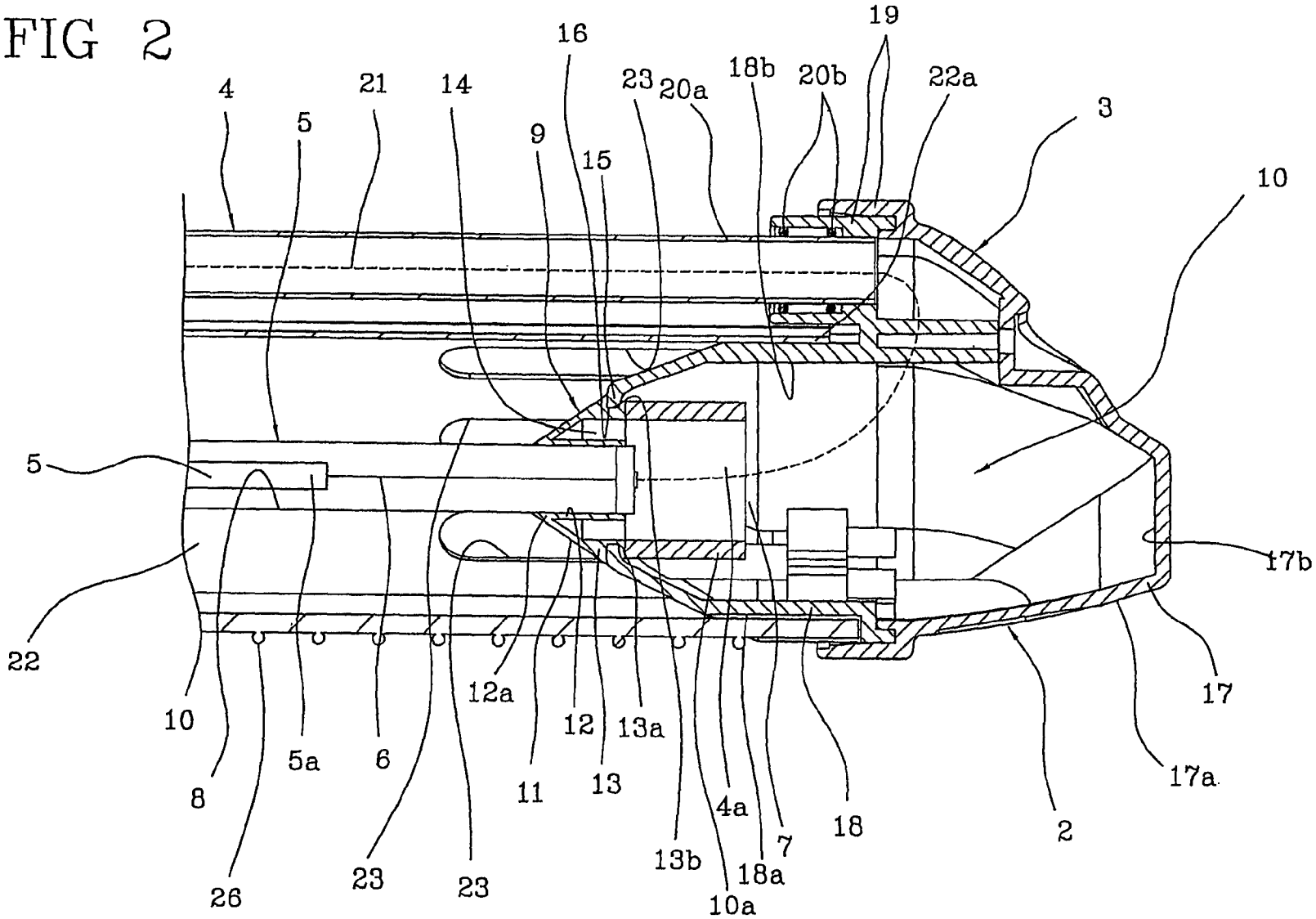
FIG. 2 is a magnified view of a detail of the device as in the preceding figure.
Figure 3:
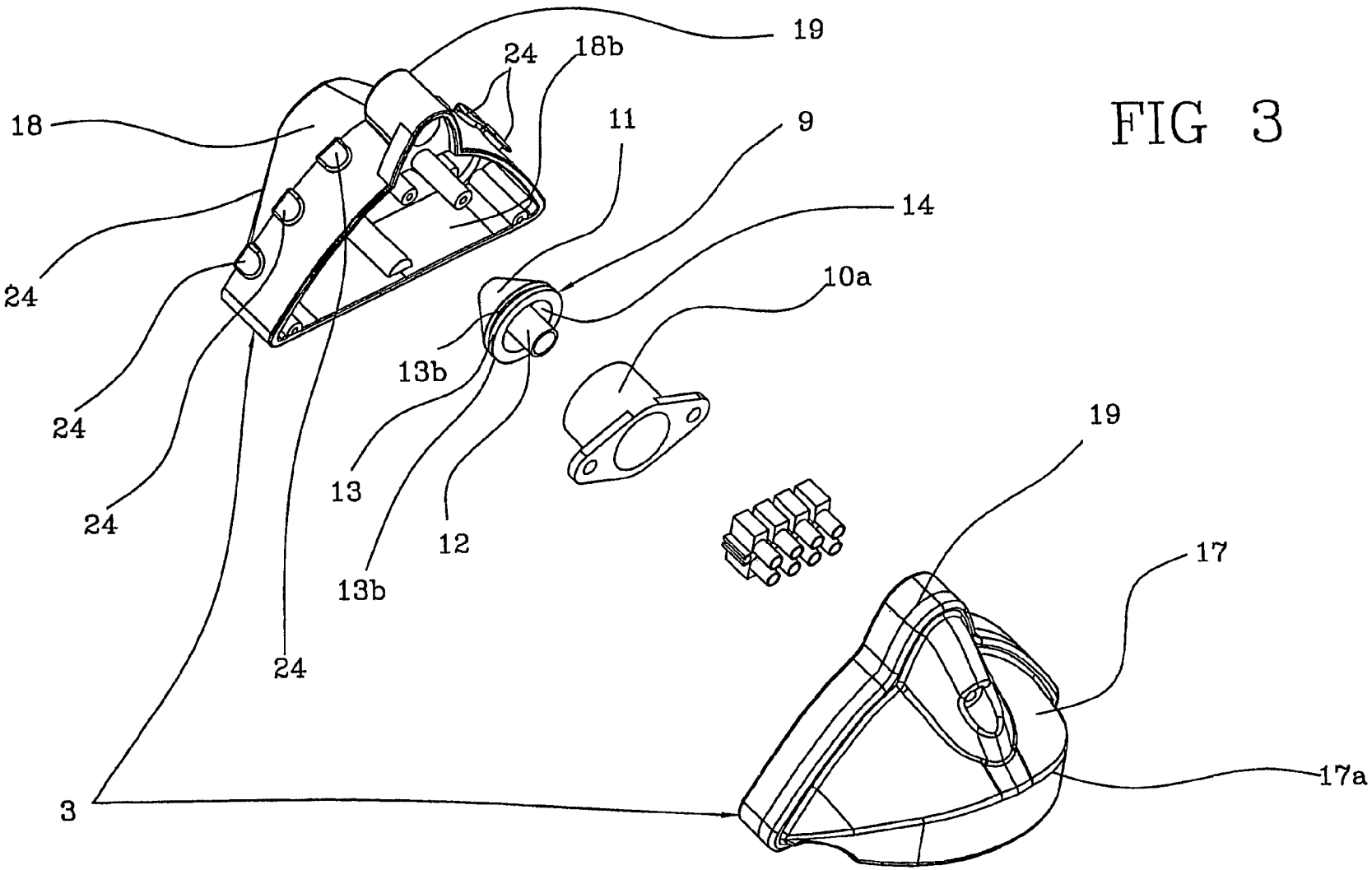
FIG. 3 is a perspective exploded view of a detail of the device as in the preceding figures.
Figure 4:
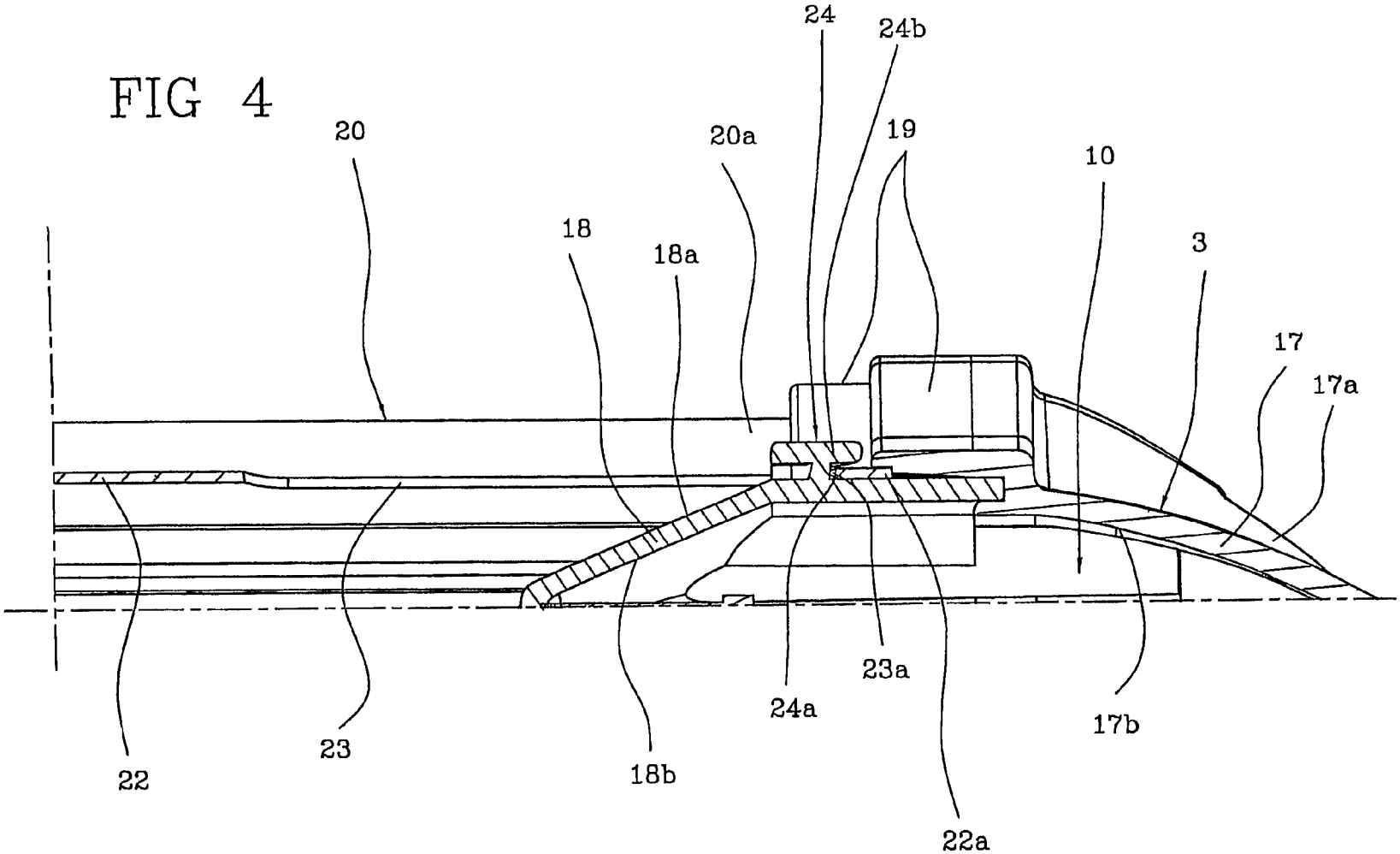
FIG. 4 is a section of the device as in the preceding figures, made according to line IV-IV of FIG. 3.

As shown in FIGS. 1 and 2, the radiant element 4 comprises at least a central body 5 for instance made of carbon, which heats up electrically thanks to its resistance, having mutually opposed ends 5*a*. The radiant element 4 further has at least two electrical conductors 6 electrically connected to the ends 5*a* of the central body 5 and electrically connected to electrical connection terminals 7 so as to ensure the electrical supply to said central body.

In addition, the radiant element 4 has at least an envelope 8 made of a transparent heat-resistant material, extending basically parallel around the central body 5 and the electrical conductors 6 so as to vacuum-enclose the latter on the electrical connection terminals 7.

During the operating state of the radiant element 4, the central body 5 defines on the envelope 8 a central area referred to with A in Figure A, which is particularly subject to heating, whereas the electrical conductors 6 define peripheral areas B in which temperature is dramatically lower than the temperature detected in area A defined by the central body 5, since their resistance to the passage of electric current is far lower than the electrical resistance of the central body 5.

Still referring to FIGS. 1 and 2, the peripheral areas B of the envelope 8 define together with the electrical conductors 6 and the electrical connection terminals 7 ends 4*a* of the radiant element 4, which are engaged to the hooking assemblies 3 of the supporting frame 2. Advantageously, the radiant element 4 engages the hooking assemblies 3 by means of corresponding elastic connection elements 9, each placed between the end 4*a* of the radiant element 4 and the hooking assembly 3 of the supporting frame 2. Each elastic connection element 9 is preferably wholly made of silicone-based elastomer, so as to act both as shock absorber absorbing collisions and/or vibrations, if present, which may involve the supporting structure 2 of the device 1, and as sealing packet between the radiant element 4 and the corresponding hooking assembly 3 of the supporting structure 2.

Advantageously, each electrical conductor 6 of the radiant element 4 develops longitudinally for a length not below 25 mm, so that it defines on the envelope 8 a peripheral area B with a convenient extension so as to allow the elastic connection element 9 to engage in a position sufficiently distant from the heating central area A. It can thus be avoided that the elastic connection elements 9 are damaged by overheating due to the high temperatures reached by the central area A of the radiant element 4.

Still referring to FIGS. 1 and 2, each hooking assembly 3 defines a housing chamber 10 for housing and protecting the above electrical connection terminals 7. Each housing chamber 10 is further conveniently sealed by the corresponding elastic connection element 9, so that the corresponding electrical connection terminals 7 are completely isolated from the surrounding environment.

As can be seen in FIGS. 1 and 2, each elastic connection element 9 comprises an inner tubular portion 12 fitted onto the corresponding end 4*a* of the radiant element 4, and an outer collar 13 coaxial to the inner tubular portion 12 and associated to the corresponding hooking assembly 3.

Each elastic connection element 9 further comprises a portion 11 basically shaped as a frustum of cone, coaxial to the radiant element 4 and converging towards the latter getting away from the corresponding hooking element 3. Said portion 11 shaped as a frustum of cone extends from a first end 12*a* of the inner tubular portion 12 as far as the outer collar 13, thus defining with the latter two a ring-shaped cavity 14 pointing towards the corresponding housing chamber 10. Preferably, the inner tubular portion 12 of each elastic connection element 9 has in its operating condition a diameter corresponding basically to the diameter of the end 4*a* of the radiant element 4, but it is preferably manufactured with a diameter lower than the latter, so that it requires a forced engagement of said elastic connection element onto the radiant element 4.

In order to ensure an optimal insulation of the housing chambers 10 from the surrounding environment, the outer collar 13 of each elastic connection element 9 is advantageously provided on one of its edges 13*a* opposed to the first end 12*a* of the inner tubular portion 12 with at least a circumferential groove 13*b*, designed to engage a circumferential protrusion 15 of the hooking assembly 3 of the supporting frame 2.

In further detail, the circumferential protrusion 15 of each hooking assembly 3 defines on said assembly at least an engaging opening 16 facing the housing chamber 10 and got through coaxially by the end 4*a* of the radiant element 4.

In order to ensure a stable engagement of each elastic connection element 9, the device can further include a pair of blocking spacers 10*a*, each of which is fastened inside the hooking assembly 3 so as to act axially against the outer collar 13 of the elastic connection element 9.

Moreover, in order to simplify assembly and/or disassembly of the device 1, each hooking element 3 preferably comprises a first cap 17 to be associated by means of suitable threaded connecting elements 27 to a second cap 18 carrying the aforesaid engaging opening 16. Both the first and the second cap 17, 18 have convex portions 17*a*, 18*a* pointing outside the housing chamber 10 and hollow portions 17*b*, 18*b* mutually facing each other so as to define said housing chambers.

Advantageously, each hooking assembly 3 further has an inserting portion 19 for the axial engagement of at least a connecting rod 20 housing electrical conductors 21 connecting the electrical connection terminals 7 of the ends 4*a* of the radiant element 4.

The connecting rod 20 extends basically parallel to the radiant element 4 and has opposed ends 20*a* engaging the inserting portions 19 of the corresponding hooking assemblies 3, after the introduction of suitable sealing packets 20*b*. Preferably, the connecting rod 20 is basically tubular and made of a waterproof material, so that the electrical conductors 21 connecting the electric connection terminals 7 of the radiant element 4 are insulated from the outer environment without the need for expensive and bulky box-shaped housing frames.

Still referring to FIGS. 1 and 2, the supporting frame 2 of the device 1 further comprises at least a reflecting plate-shaped body 22, basically parallel to the longitudinal development of the radiant element 4 and having mutually opposed end edges 22*a* engaged each to one of the hooking assemblies 3 of the supporting frame 2. Each of the end edges 22*a*, as well as the reflecting plate-shaped body 22 as a whole, extend around the radiant element 4 without intersecting with any of their parts the development of said radiant element. As shown in FIGS. 1 and 2, the reflecting plate-shaped body 22 preferably has on each elastic connection element 9 a plurality of openings 23 for ventilation.

Said openings 23 are designed to be engaged by engaging hooks 24 carried by the corresponding hooking assemblies 3. In detail, said engaging hooks 24 are distributed on the second cap 18 of each hooking assembly 3 in positions corresponding to those of the openings 23 to be engaged and are designed to be held against the reflecting plate-shaped body 22 as a consequence of the aforesaid threaded elements 27, oriented parallel to the openings, being clamped, which are used for fastening the first caps 17.

Each engaging hook 24 has in longitudinal section a basically T-shaped profile, with an abutting portion 24*a* transversal to the longitudinal development of the radiant element 4, and a hooking portion 24*b* basically parallel to the longitudinal development of the radiant element 4. Thus, when the reflecting plate-shaped body 22 is mounted onto the hooking assemblies 3 of the supporting frame 2, the abutting portions 24 are arranged against inner edges 23*a* of the openings 23, so that the reflecting plate-shaped body 22 cannot disengage axially from the hooking assemblies 3 due to their getting away.

Figure 5:
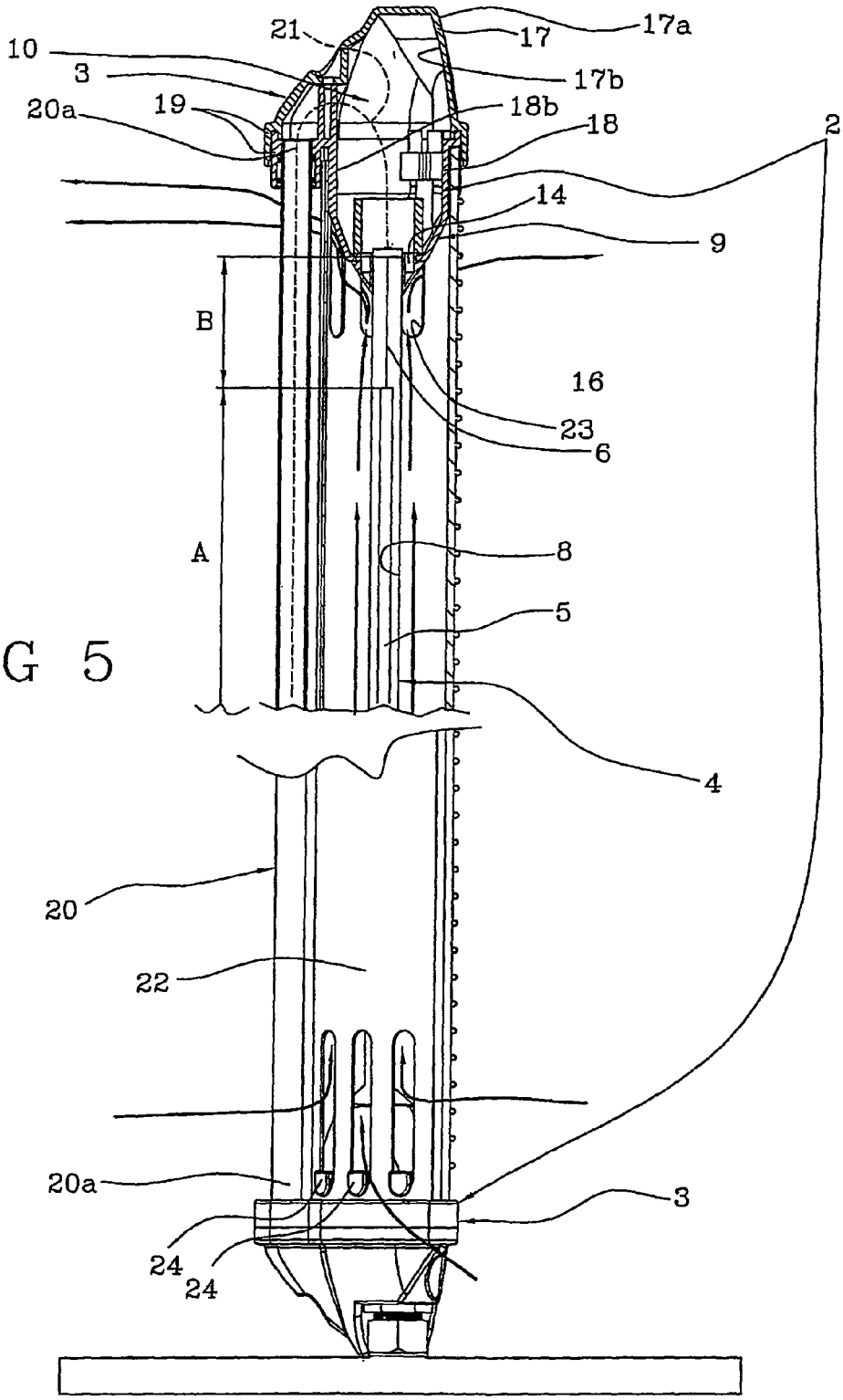
FIG. 5 shows schematically the cooling flow of the device here referred to when operating in vertical orientation.

It is further preferred that the openings 23 extend longitudinally for a greater length than the longitudinal development of the hooking portion 24*b* of the engaging hooks 24, so as to enable air to get freely through the plate-shaped body 22 on its ends. In detail, the openings 23 have a greater longitudinal development than the axial development of the elastic connection elements 9. Advantageously, the engagement between the hooking assemblies 3 and the reflecting plate-shaped body 22, together with the engagement of the connecting rod 20 into the inserting portion 19 of the hooking assemblies 3, build up a self-carrying supporting frame 2 for the radiant element 4, which can thus be arranged in any desired position. Concerning this, at least one of the hooking assemblies 3 of the supporting frame 2 can have an engaging member 25 (FIG. 1) for connecting the device 1 to a suitable vertical stand. One of the hooking assemblies 3 can further be equipped with a pedestal for vertically positioning the device 1, as in FIG. 5.

The device 1 further comprises an outer protection grid 26 extending between the hooking assemblies 3 of the supporting frame 2 and arranged on an opposed side with respect to the reflecting plate-shaped body 22.

The present invention solves the problems found in the technique and achieves the proposed aims.

First of all, the radiant device 1 according to the present invention enables to heat and/or lighten efficiently any kind of place, inside and/or outside, even in presence of water spraying, condensate and moisture, thanks to the full insulation of its electrical connections and of the conductors required for device operation. This advantageous feature is due to the cooperation between the hooking assemblies 3 defining the housing chambers 10 containing the required electrical connections, the elastic connection elements 9 insulating said housing chambers 10 on the ends 4*a* of the radiant element 4, and to the connecting rod 20 which protects the electrical connections between the ends 4*a* of the radiant element 4.

It should further be added that the elastic connection elements 9 grant to the radiant element 4 an efficient damping effect for collisions and/or vibrations, if present, which could otherwise damage said radiant element.

It should also be noted that the outer shape as a frustum of cone of each elastic connection element 9, together with the openings 23, enables an optimal operation of the device 1 also in vertical position. As a matter of fact, in such a situation, the elastic connection element 9 struck by ascending hot air deflects the latter towards the openings 23. Hot air can thus get in from the openings 23 placed below and lap the walls of the radiant element 4 and of the reflecting element 22 so as to prevent their overheating, and then get out from the openings 23 placed above without heating too much the upper area of the device 1 and its electrical components.

Moreover, the shape as a frustum of cone of each elastic connection element 9 is such that the radiations emitted by the heating element reach the surfaces of said elastic elements with very small angles of incidence, so as to prevent their overheating. Also air discharge through the openings 23 contributes to cool the surfaces of the elastic connection elements 9. The presence of the openings further reduces in an advantageous way heat conduction towards the hooking elements 3 and radiation reflection towards the elastic connection elements 9.

It should further be observed that the constructive features of the concerned device are such as to pre-serve its components from anomalous stresses due to thermal expansions. In particular, the elasticity of the elastic connection elements 9 enables to compensate efficiently the different coefficients of thermal expansion of the radiant element 4 and of the reflecting element 22. Thermal expansions of the reflecting element 22, if present, are helped by the hooking elements 3 mutually getting away, and by the inserting portions 19 sliding on the ends of the connecting rod 20.

The invention claimed is:

1. Radiant device comprising:

a supporting frame (2);

at least a radiant element (4) having two mutually opposed ends (4*a*) provided with electrical connection terminals (7) and engaged to hooking groups (3) of the supporting frame (2);

an elastic element (9) placed between each end (4*a*) of the radiant element (4) and the hooking assembly (3), so as to couple elastically said radiant element (4) with the supporting frame (2), characterized in that each of the hooking assemblies (3) delimits a housing chamber (10) for the electrical connection terminals (7), and in that the elastic element (9) encloses the end (4*a*) of the radiant element (4) so as to seal said housing chamber (10).

2. Device according to claim 1, characterized in that the elastic element (9) has a portion shaped as a frustum of cone (11) coaxial to the end (4*a*) of the radiant element (4) and converging towards said radiant element (4) getting away from the hooking assembly (3).

3. Device according to claim 1, characterized in that the elastic element (9) has an inner tubular portion (12) associated to the end (4*a*) of the radiant element (4) and an outer collar (13) associated to the hooking assembly (3).

4. Device according to claim 3, characterized in that said elastic element (9) further comprises an intermediate portion basically shaped as a frustum of cone and developing from a first end (12*a*) of the inner tubular portion (12) as far as said outer collar (13).

5. Device according to claim 4, characterized in that said inner tubular portion (12), outer collar (13) and intermediate portion of said elastic element (9) delimit a ring-shaped cavity (14) pointing towards the corresponding hooking assembly (3).

6. Device according to claim 3, characterized in that the inner tubular portion (12) is elastically fitted onto the end (4*a*) of the radiant element (4).

7. Device according to claim 3, characterized in that the outer collar (13) has a circumferential groove (13*a*) for the engagement with a protrusion (15) of the hooking assembly (3) delimiting an opening (16) facing the housing chamber (10).

8. Device according to claim 7, characterized in that the circumferential groove (15) is obtained close to an edge (13*b*) of the outer collar (13) opposed to the first end (12*a*) of the inner tubular portion (12).

9. Device according to claim 4, characterized in that the outer collar (13) converges towards the radiant element (4) getting away from the corresponding hooking assembly (3).

10. Device according to claim 1, characterized in that the elastic element (9) is wholly made of a silicone-based elastomerico material.

11. Device according to claim 1, characterized in that each of the hooking assemblies (3) of the supporting frame (2) comprises a first and a second cap (17, 18) joined to each other so as to define the housing chamber (10).

12. Device according to claim 11, characterized in that the second cap (18) has an opening (16) facing the housing chamber (10) for the engagement with the elastic element (9).

13. Device according to claim 1, characterized in that the supporting frame (2) further comprises at least a connecting rod (20) arranged between the hooking assemblies (3), so as to house electrical conductors (21) connecting the electrical connection terminals (7) of the ends (4*a*) of the radiant element (4).

14. Device according to claim 1, characterized in that the supporting frame (2) further comprises a reflecting plate-shaped body (22) basically parallel to the longitudinal development of the radiant element (4) and having mutually opposed end edges (22*a*) engaged each to one of the hooking assemblies (3) of the supporting frame (2).

15. Device according to claim 14, characterized in that the reflecting plate-shaped body (22) has a plurality of openings (23) on each of the elastic elements (9).

16. Device according to claim 15, characterized in that each of the hooking assemblies (3) further comprises a plurality of engaging hooks (24) with the openings (23) of the reflecting plate-shaped body (22), so as to block said reflecting plate-shaped body (22) to the hooking assembly (3).

17. Device according to claim 16, characterized in that the engaging hooks (24) are placed on the second cap (18) and held against the reflecting plate-shaped body (22) by the fastening elements (27) between the second cap (18) and the first cap (17).

18. Device according to claim 1, characterized in that said radiant element (4) comprises:

a central body (5) to be electrically heated;

two electrical conductors (6) electrically connected to said central body (5) on the opposed ends (5*a*) of the latter;

an envelope (8) made of transparent material extending around said central body (5) and around said conductors (6), said central body (5) defining on said envelope (8) a central area (A) subject to heating and said conductors (6) defining peripheral areas (B) to be engaged by the elastic elements (9).

19. Device according to claim 18, characterized in that each peripheral area (B) of the envelope (8) defined by the conductor (6) of said radiant element (4) extends longitudinally for not less than 25 mm.

* * * * *